US012607189B2

(12) United States Patent
Era

(10) Patent No.: US 12,607,189 B2
(45) Date of Patent: Apr. 21, 2026

(54) COMPRESSOR WITH A MUFFLER COVER

(71) Applicant: DAIKIN INDUSTRIES, LTD., Osaka (JP)

(72) Inventor: Shuji Era, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 0 days.

(21) Appl. No.: 18/520,046

(22) Filed: Nov. 27, 2023

(65) Prior Publication Data

US 2024/0102473 A1 Mar. 28, 2024

Related U.S. Application Data

(63) Continuation of application No. PCT/JP2022/022656, filed on Jun. 3, 2022.

(30) Foreign Application Priority Data

Jun. 3, 2021 (JP) ..... 2021-093685

(51) Int. Cl.
*F04C 29/06* (2006.01)
*F04C 18/356* (2006.01)

(52) U.S. Cl.
CPC ..... *F04C 29/065* (2013.01); *F04C 18/356* (2013.01); *F04C 29/068* (2013.01)

(58) Field of Classification Search
CPC ..... F04C 29/065; F04C 18/356; F04C 29/068
See application file for complete search history.

(56) References Cited

U.S. PATENT DOCUMENTS 4,990,073 A * 2/1991 Kudo ..... F04C 18/3564 181/403
7,527,484 B2 * 5/2009 Kim ..... F04C 29/065 418/94
8,926,295 B2 * 1/2015 Yanagisawa ..... F04C 29/065 417/423.15

(Continued)

FOREIGN PATENT DOCUMENTS

CN 108626125 A 10/2018
JP 60-180792 U 11/1985

(Continued)

OTHER PUBLICATIONS

Translation from IP.com of the Japanese Utility Patent Publication JP 63-115590 U; Inventor: Sawada; Published: Jul. 26, 1988. ( Year: 1988).*

(Continued)

*Primary Examiner* — Mary A Davis
(74) *Attorney, Agent, or Firm* — Spencer Fane LLP

(57) ABSTRACT

A compressor includes a compression mechanism. The compression mechanism includes a front head including a boss portion, and a muffler cover attached to the front head. The front head includes a first contact surface that is part of a conical side surface on an outer peripheral surface of the boss portion. The muffler cover includes a first surface having a circular first opening formed in the first surface, into which the boss portion is inserted. A first end portion of the first surface forming the first opening is in contact with the first contact surface in a state in which the muffler cover is attached to the front head.

5 Claims, 7 Drawing Sheets

ENLARGED VIEW OF PORTION B

(56) References Cited

U.S. PATENT DOCUMENTS

| | | | | |
|---|---|---|---|---|
| 10,731,650 | B2 * | 8/2020 | Ku | F04C 29/065 |
| 2018/0266423 | A1 | 9/2018 | Ku et al. | |
| 2019/0338788 | A1 | 11/2019 | Shimizu | |

FOREIGN PATENT DOCUMENTS

| | | | |
|---|---|---|---|
| JP | 63-115590 | U | 7/1988 |
| JP | 5-133377 | A | 5/1993 |
| KR | 10-2004-0071934 | A | 8/2004 |
| KR | 10-2018-0090675 | A | 8/2018 |
| WO | 2018/147430 | A1 | 8/2018 |

OTHER PUBLICATIONS

International Preliminary Report of corresponding PCT Application No. PCT/JP2022/022656 dated Dec. 14, 2023.
International Search Report of corresponding PCT Application No. PCT/JP2022/022656 dated Aug. 2, 2022.
European Search Report of corresponding EP Application No. 22 81 6233.5 dated Sep. 23, 2024.

* cited by examiner

ENLARGED VIEW OF PORTION A

ENLARGED VIEW OF PORTION B

COMPRESSOR WITH A MUFFLER COVER

CROSS-REFERENCE TO RELATED APPLICATIONS

This is a continuation of International Application No. PCT/JP2022/022656 filed on Jun. 3, 2022, which claims priority to Japanese Patent Application No. 2021-093685, filed on Jun. 3, 2021. The entire disclosures of these applications are incorporated by reference herein.

BACKGROUND

Technical Field

The present disclosure relates to a compressor.

Background Art

Japanese Unexamined Patent Publication No. 05-133377 discloses a compressor in which a space (shell space), into which a fluid compressed in a compression element is discharged, is formed by a front head (upper frame body) and a muffler cover (muffler). In the compressor of Japanese Unexamined Patent Publication No. 05-133377, the position of a fluid discharge port formed in the muffler cover is adjusted to cancel the pressure pulsation of the fluid discharged from the compression element so that the vibration and noise of the casing caused by the pressure pulsation are reduced.

SUMMARY

A compressor includes a compression mechanism. The compression mechanism includes a front head including a boss portion and a muffler cover attached to the front head. The front head includes a first contact surface that is part of a conical side surface on an outer peripheral surface of the boss portion. The muffler cover includes a first surface having a circular first opening formed therein, into which the boss portion is inserted. A first end portion of the first surface forming the first opening is in contact with the first contact surface in a state where the muffler cover is attached to the front head.

DETAILED DESCRIPTION OF EMBODIMENT(S)

First Embodiment (1) Overall Configuration

Figure 1:
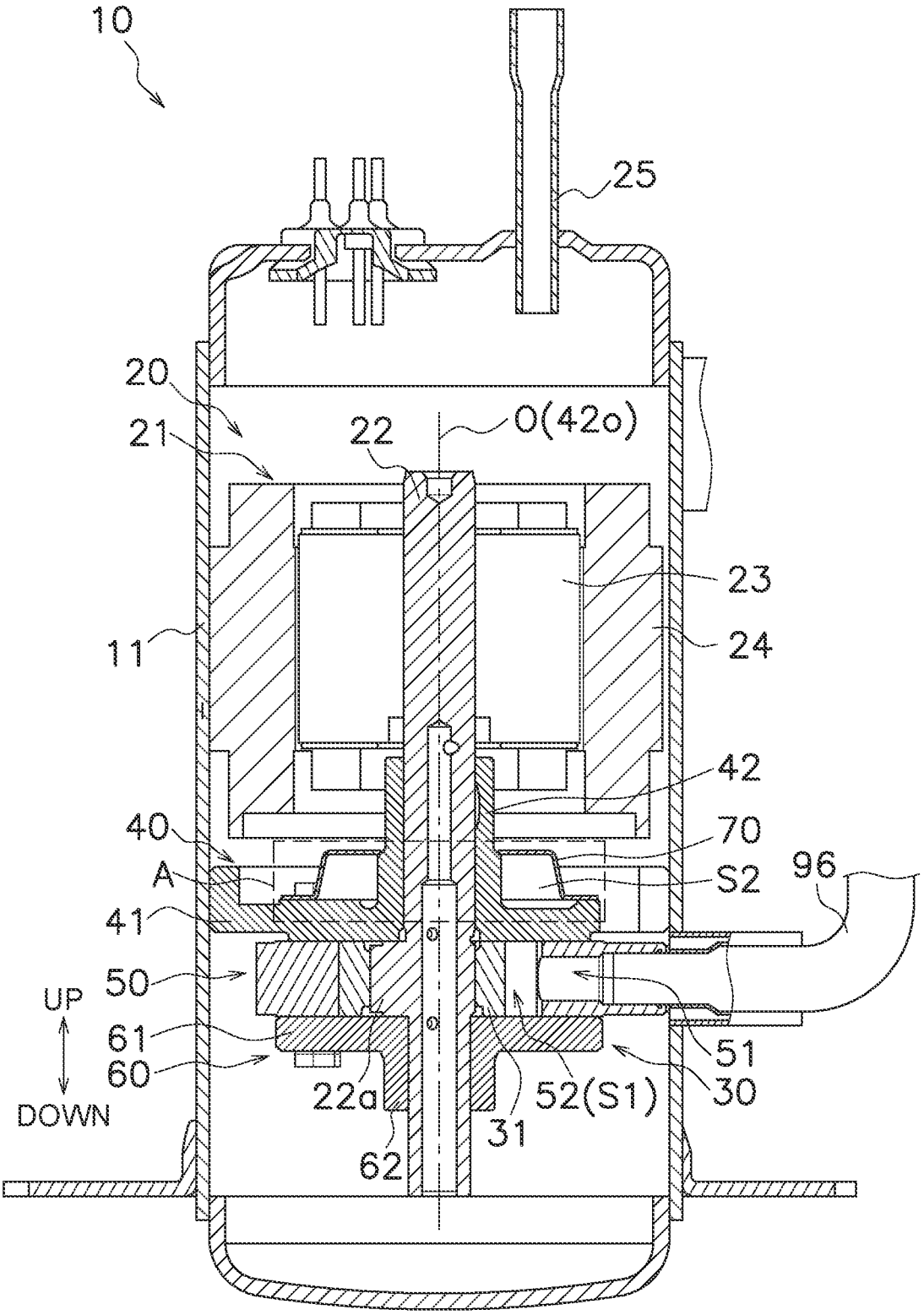
FIG. 1 is a schematic longitudinal sectional view of a compressor 10 according to a first embodiment.
Figure 2:
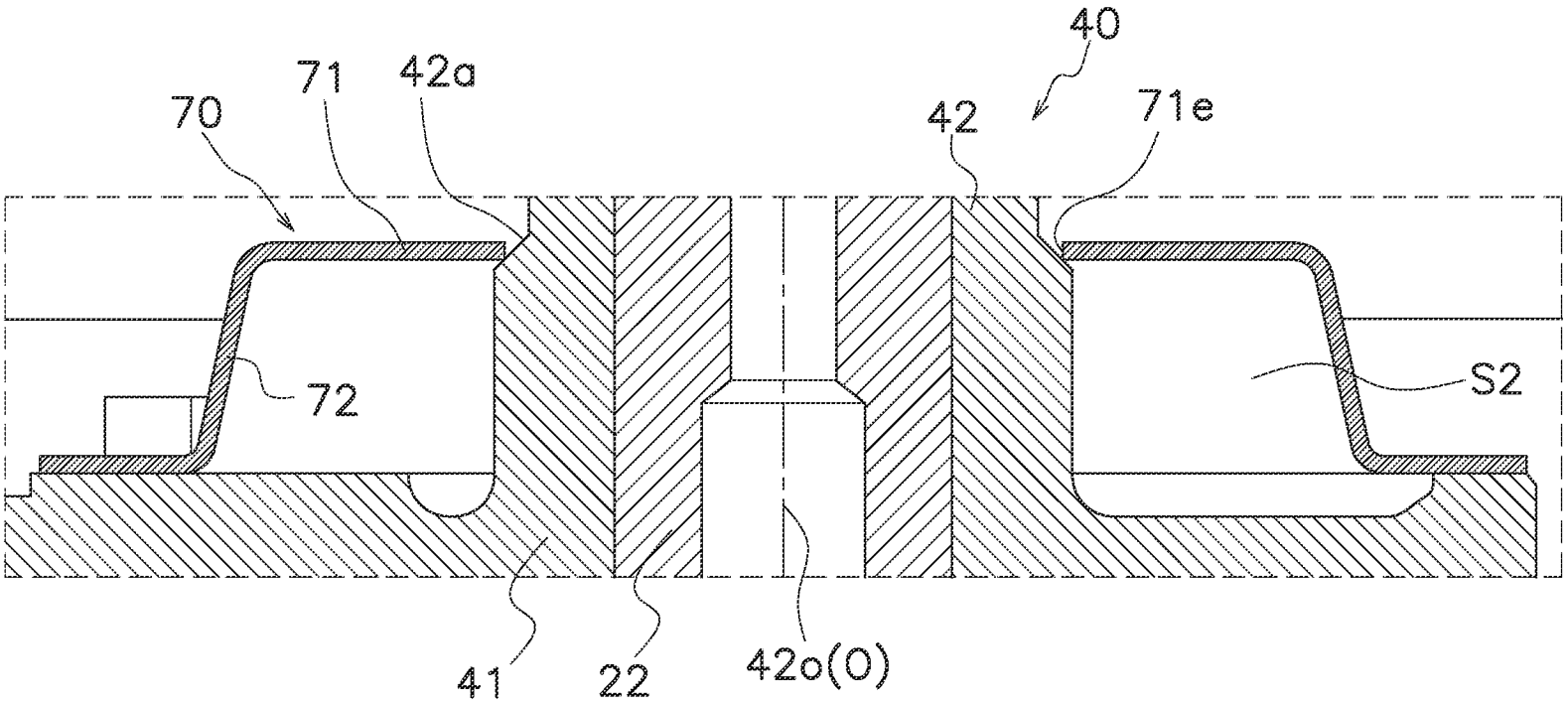
FIG. 2 is an enlarged view of a portion A surrounded by a dotted line in FIG. 1.

FIG. 1 is a schematic longitudinal sectional view of a compressor 10 according to a first embodiment. FIG. 2 is an enlarged view of a portion A surrounded by a dotted line in FIG. 1. The compressor 10 is a rotary compressor in which a piston is eccentrically rotated inside a cylinder to change the volume of a space inside the cylinder and thus compress a fluid into a predetermined pressure. Although not limited, the compressor 10 is used to compress a refrigerant in a refrigeration cycle device such as an air conditioner or a heat pump type water heater. The compressor 10 includes a substantially cylindrical casing 11 serving as a sealed container, a drive mechanism 20 accommodated in the casing 11, and a compression mechanism 30 serving as a compression element. The compressor 10 suctions the refrigerant from a suction pipe 96 and discharges the refrigerant, which is compressed to have a high temperature and a high pressure, from a discharge pipe 25 toward a heat exchanger of a refrigeration apparatus (not illustrated).

The up and down directions used in the description below are the directions indicated by arrows in FIG. 1.

(2) Detailed Configuration (2-1) Drive Mechanism 20

The drive mechanism 20 drives the compression mechanism 30. The drive mechanism 20 is housed above the compression mechanism 30 inside the casing 11. The drive mechanism 20 includes a motor 21 as a drive source and a shaft 22 as a drive shaft attached to the motor 21. The motor 21 and the shaft 22 are provided such that their axial centers coincide with an axis O.

(2-1-1) Motor 21

The motor 21 primarily includes a rotor 23 and a stator 24. The rotor 23 has a columnar shape. The shaft 22 is fixed to the rotor 23 such that their axial centers coincide with each other. The rotor 23 includes laminated electromagnetic steel plates and a magnet embedded in a rotor body. The stator 24 has a cylindrical shape and is fixed to an inner peripheral surface of the casing 11. The rotor 23 is provided on a radially inner side of the stator 24 via a space (air gap) having a predetermined width. The stator 24 is formed by using laminated electromagnetic steel plates and a coil wound around a stator body. The rotor 23 rotates together with the shaft 22 by an electromagnetic force generated in the stator 24 when a current flows through the coil.

(2-1-2) Shaft

The shaft 22 transmits the rotation of the motor 21 to the compression mechanism 30. The shaft 22 includes a crankpin 22*a* that is provided below the rotor 23 and is eccentric from the axial center. The crankpin 22*a* is inserted into a piston 31, described below, of the compression mechanism 30 in a state where the rotational force from the rotor 23 is transmittable. When the shaft 22 rotates, the crankpin 22*a* eccentrically rotates around the axial center and causes the piston 31 of the compression mechanism 30 to revolve around the axial center. As a result, the driving force of the motor 21 is transmitted to the compression mechanism 30 via the shaft 22.

(2-2) Compression Mechanism 30

The compression mechanism 30 suctions and compresses the refrigerant via the suction pipe 96. The compression mechanism 30 is housed below the drive mechanism 20 inside the casing 11. The compression mechanism 30 is a rotary compression mechanism and primarily includes a front head 40, a cylinder 50, the piston 31, a rear head 60, and a muffler cover 70. The refrigerant compressed by the compression mechanism 30 is discharged from a discharge hole (not illustrated) to a space between the motor 21 and the compression mechanism 30 through a muffler space S2 described below.

(2-2-1) Cylinder 50

The cylinder 50 forms a compression chamber 51, which compresses the refrigerant, together with the piston 31 housed inside. The cylinder 50 is a plate-shaped member that has a predetermined width and is provided to be perpendicular to the vertical direction. The cylinder 50 includes a suction passage 51 and a cylinder chamber 52.

The cylinder chamber 52 is formed by closing a through-hole, which is formed in the vertical direction of the cylinder 50 and has a substantially circular shape in a plan view, with the rear head 60 from below and the front head 40 from above.

The suction passage 51 is a refrigerant channel that communicates between the cylinder chamber 52 and the outside of the cylinder 50. One end of the suction passage 51 is opened to the cylinder chamber 52, and the other end of the suction passage 51 is opened to an outer surface of the cylinder chamber 52. A distal end portion of the suction pipe 96 is inserted into the other end of the suction passage 51. The cylinder chamber 52 accommodates the piston 31.

(2-2-2) Piston 31

The piston 31 is a plate member that is circular in a plan view and is accommodated in the cylinder chamber 52. The piston 31 is integrally mounted on the crankpin 22*a* of the shaft 22. When the shaft 22 rotates, the piston 31 revolves around the axis O with part of the outer peripheral surface in contact with the inner peripheral surface of the cylinder 50 forming the cylinder chamber 52 as viewed from above.

(2-2-3) Front Head 40

The front head 40 includes a front head disk portion 41 that closes an upper surface of the cylinder 50 and a front head boss portion 42 that extends upward from a peripheral edge of an opening formed in the center of the front head disk portion 41. The front head 40 is fixed to the casing 11.

The front head disk portion 41 is provided with a discharge hole (not illustrated). The refrigerant compressed in the compression chamber S1 whose volume changes in the cylinder chamber 52 of the cylinder 50 is discharged through the discharge hole. The front head disk portion 41 is provided with a discharge valve (not illustrated) that opens and closes an outlet of the discharge hole. When the pressure in the compression chamber S1 become higher than the pressure in the muffler space S2, because of the pressure gap, the discharge valve opens to allow the refrigerant to be discharged into the muffler space S2 through the discharge hole.

The front head boss portion 42 has a cylindrical shape. The front head boss portion 42 has the shaft 22 inserted into the inner periphery thereof and functions as a bearing of the shaft 22. The front head boss portion 42 is formed such that an axial center 42*o* coincides with the axis O.

The front head 40 includes a first contact surface 42*a* that is part of a conical side surface on the outer peripheral surface of the front head boss portion 42. According to the present embodiment, the first contact surface 42*a* forms a side surface of a truncated cone whose diameter increases from top to bottom. In the plane including the axial center 42*o* of the front head boss portion 42, an angle a1 formed between the axial center 42*o* and the first contact surface 42*a* is preferably more than 0° and less than 45°.

(2-2-4) Rear Head 60

The rear head 60 includes a rear head disk portion 61 that closes a lower surface of the cylinder 50 and a rear head boss portion 62 that extends downward from a peripheral edge portion of an opening formed in the center of the rear head disk portion 61.

The rear head boss portion 62 has a cylindrical shape. The rear head boss portion 62 has the shaft 22 inserted into the inner periphery thereof and functions as a bearing of the shaft 22.

(2-2-5) Muffler Cover 70

Figure 3:
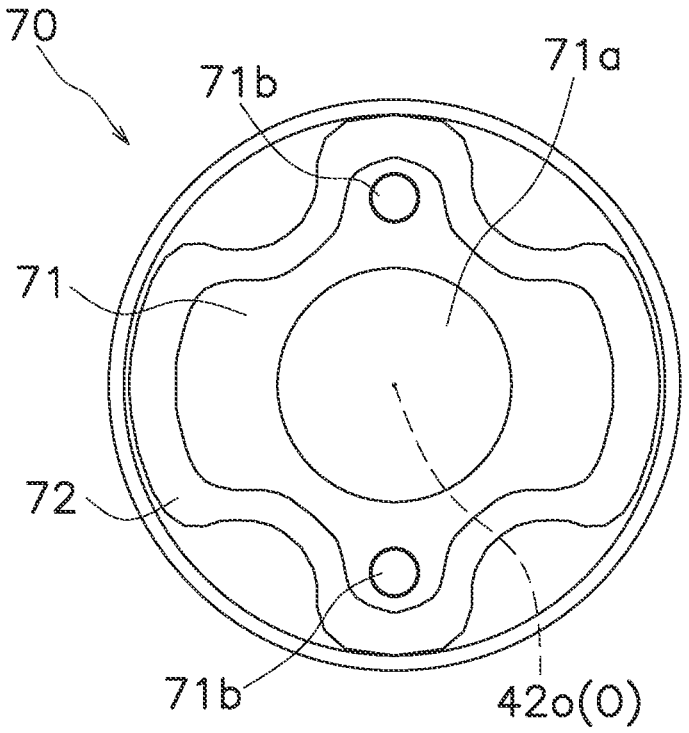
FIG. 3 is a plan view of a muffler cover 70 as viewed from above.

The muffler cover 70 is a member that forms the muffler space S2 to reduce vibration and noise caused by pressure pulsation of the refrigerant discharged from the compression mechanism 30. FIG. 3 is a plan view of the muffler cover 70 as viewed from above. The muffler cover 70 primarily includes an upper surface 71, which is a surface perpendicular to the vertical direction, and a side surface 72 extending downward from an outer peripheral edge of the upper surface 71.

The upper surface 71 is provided with a first muffler opening 71*a* and two second muffler openings 71*b*. The muffler cover 70 is formed of, but not limited thereto, a metal plate having a plate thickness t of approximately 1 mm. The upper surface 71 is an example of a first surface.

The first muffler opening 71*a* is a circular opening formed to cause the front head boss portion 42 to penetrate therethrough. The first muffler opening 71*a* is formed such that a first end portion 71*e* of the upper surface 71 forming the first muffler opening 71*a* is in contact with the first contact surface 42*a* in a state where the muffler cover 70 is attached to the front head 40. According to the present embodiment, as illustrated in FIG. 2, the first muffler opening 71*a* is formed such that the lower end of the first end portion 71*e* comes into contact (line contact) with the first contact surface 42*a* in a state where the front head boss portion 42 is inserted from under the first muffler opening 71*a* and the muffler cover 70 is attached to the upper surface of the front head 40. The first muffler opening 71*a* is an example of a first opening.

The second muffler opening 71*b* is a circular opening formed to cause the refrigerant to flow from the muffler space S2 into the space between the motor 21 and the compression mechanism 30. When viewed in the extending direction of the front head boss portion 42, the two muffler openings 70*b* are formed on the circumference of a predetermined radius around the axial center 42*o* of the front head boss portion 42 in positions at intervals of 180° with the axial center 42*o* as an axis (see FIG. 3). According to the present embodiment, when viewed in the extending direction of the front head boss portion 42, the two second muffler openings 71*b* are formed in positions such that the centers thereof are located on the circumference of a predetermined radius around the axial center 42*o* of the front head boss portion 42 and the centers thereof have an interval of 180° with the axial center 42*o* as an axis. The second muffler opening 71*b* is an example of a second opening.

The muffler cover 70 is attached to the front head disk portion 41 in a state where the front head boss portion 42 is inserted into the first muffler opening 71*a*. The muffler cover 70 forms the muffler space S2 together with the upper surface of the front head disk portion 41 and the outer peripheral surface of the front head boss portion 42. As described above, when the muffler cover 70 is attached to the upper surface of the front head disk portion 41, the first end portion 71*e* of the upper surface 71 is in contact with the first contact surface 42*a*.

(3) Operation of Compressor

When the rotor 23 rotates, the eccentric rotation of the crankpin 22*a* causes the piston 31 of the compression mechanism 30 to revolve inside the cylinder chamber 52, which changes the volume of the compression chamber S1. As a result, the refrigerant is suctioned into the compression chamber S1 through the suction passage 51. The suctioned refrigerant is compressed by the piston 31 and flows out to the muffler space S2 through the discharge hole. The refrigerant having flowed out to the muffler space S2 is discharged into the space between the motor 21 and the compression mechanism 30 through the two second muffler openings 71*b* of the muffler cover 70. The refrigerant discharged to the outside of the muffler space S2 passes through the air gap between the rotor 23 and the stator 24 of the motor 21 and is discharged from the discharge pipe 25.

Furthermore, in the compressor 10, when viewed in the extending direction of the front head boss portion 42, the two second muffler openings 71*b* are formed on the circumference of a predetermined radius around the axial center 42*o* of the front head boss portion 42 in positions at intervals of 180° with the axial center 42*o* as an axis, and therefore the refrigerant discharged from the second muffler openings 71*b* serves as a symmetric sound source. As a result, the occurrence of standing waves caused by pressure pulsation of the refrigerant flowing out of the compression mechanism 30 is suppressed, and the occurrence of vibration and noise caused by the standing waves is suppressed.

(4) Feature (4-1)

The compressor 10 includes the compression mechanism 30. The compression mechanism 30 includes the front head 40 including the front head boss portion 42 and the muffler cover 70 attached to the front head 40. The front head 40 includes the first contact surface 42*a* that is part of the conical side surface on the outer peripheral surface of the front head boss portion 42. The muffler cover 70 includes the upper surface 71 having the circular first muffler opening 71*a* formed therein, into which the front head boss portion 42 is inserted. The first end portion 71*e* of the first surface 71 forming the first muffler opening 71*a* is in contact with the first contact surface 42*a* in a state where the muffler cover 70 is attached to the front head 40.

In the compressor 10, the front head boss portion 42 is inserted from under the first muffler opening 71*a* so that the first contact surface 42*a* and the first end portion 71*e* may be in line contact with each other. Accordingly, the gap between the front head boss portion 42 and the first muffler opening 71*a* is sealed by the first contact surface 42*a* and the lower end of the first end portion 71*e* so that the refrigerant is prevented from flowing out through the gap between the front head boss portion 42 and the first muffler opening 71*a*. As a result, the compressor 10 suppresses the occurrence of vibration and noise caused by pressure pulsation of the compressed refrigerant flowing out from the compression mechanism 30.

The compressor according to the related art disclosed in PTL 1 is designed to reduce the gap (clearance) between the front head boss portion and the boss portion of the muffler cover with the intention of preventing the refrigerant from flowing out through the gap between both members. However, the reduced gap causes a problem of a reduction in assemblability. On the other hand, in the compressor 10, as the first contact surface 42*a*, which is part of the conical side surface, and the first end portion 71*e* are in contact with each other, the sealing property may be ensured without designing the small clearance between the outer diameter of the front head boss portion 42 and the inner diameter of the first muffler opening 71*a*. Therefore, the compressor 10 suppresses the occurrence of vibration and noise caused by pressure pulsation of the compressed refrigerant without causing deterioration in assemblability.

In addition, the compressor 10 suppresses the clearance formed between the first contact surface 42*a* of the front head boss portion 42 and the first muffler opening 71*a*, and thus the muffler cover 70 may be positioned in the horizontal direction more easily than in the related art.

(4-2)

The muffler cover 70 is provided with the two second muffler openings 71*b* through which the refrigerant compressed by the compression mechanism 30 passes. When viewed in the extending direction of the front head boss portion 42, the two second muffler openings 71*b* are formed on the circumference of a predetermined radius around the axial center 42*o* of the front head boss portion 42 in positions at intervals of 180° with the axial center 42*o* as an axis.

Thus, the refrigerant discharged from the second muffler openings 71*b* serves as a symmetric sound source, and the occurrence of vibration and noise caused by pressure pulsation of the compressed refrigerant is effectively suppressed.

Second Embodiment (1) Overall Configuration

Figure 4:
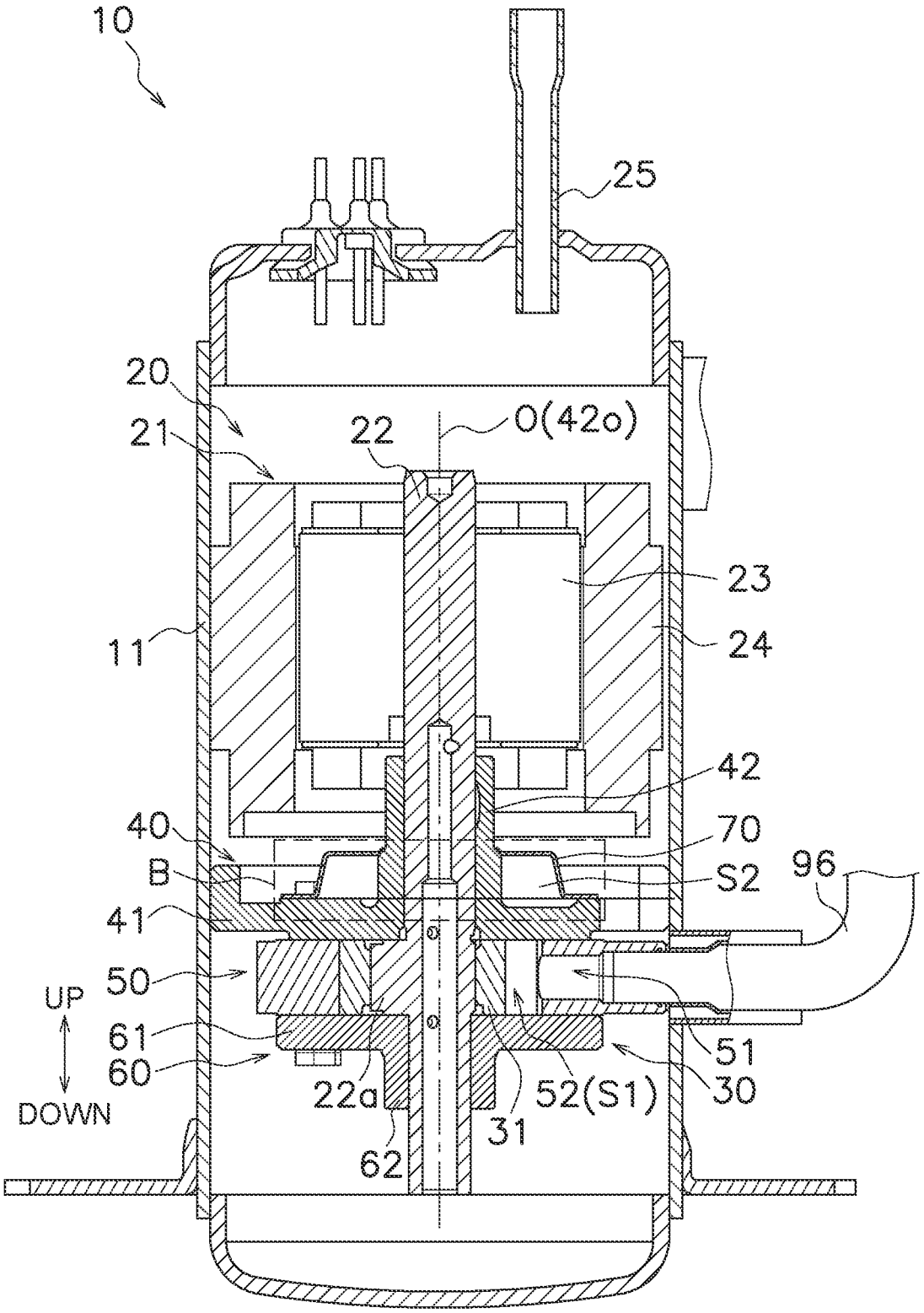
FIG. 4 is a schematic longitudinal sectional view of the compressor 10 according to a second embodiment.
Figure 5:
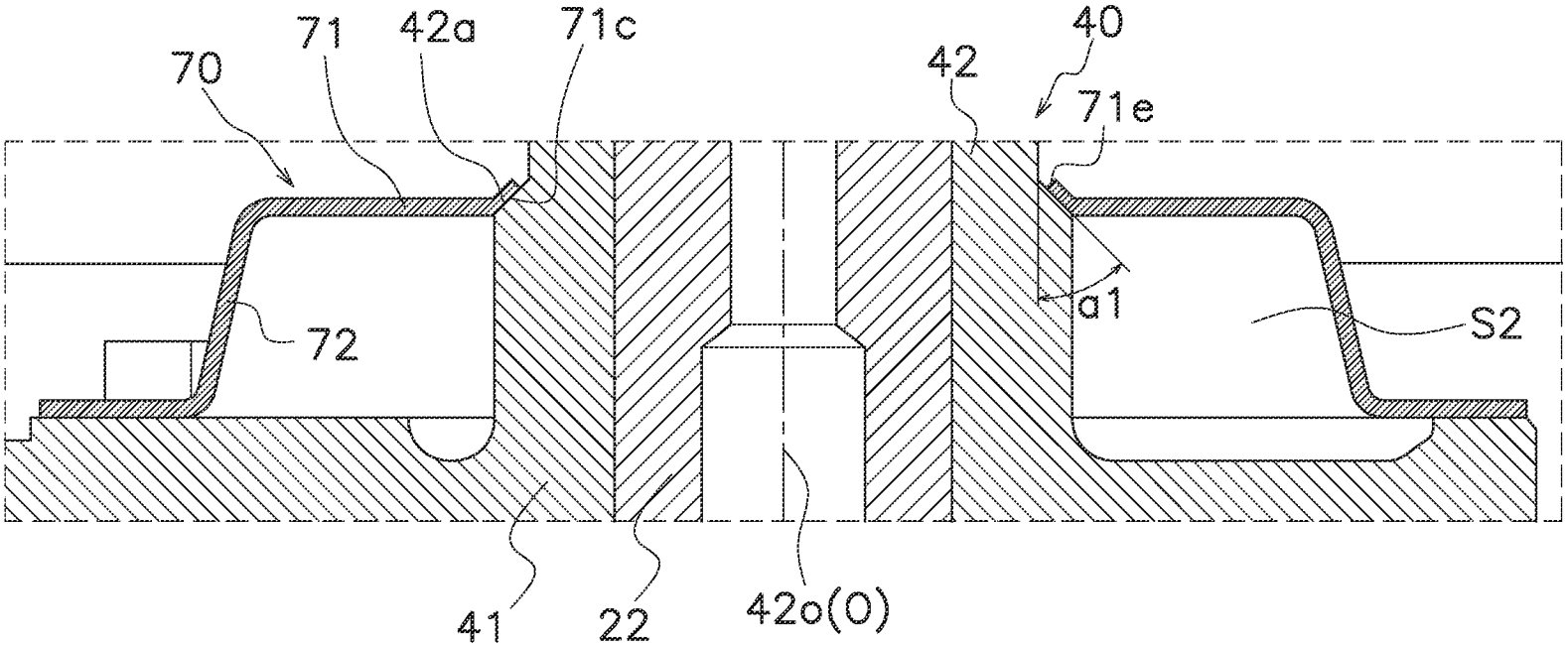
FIG. 5 is an enlarged view of a portion B surrounded by a dotted line in FIG. 4.
Figure 6:
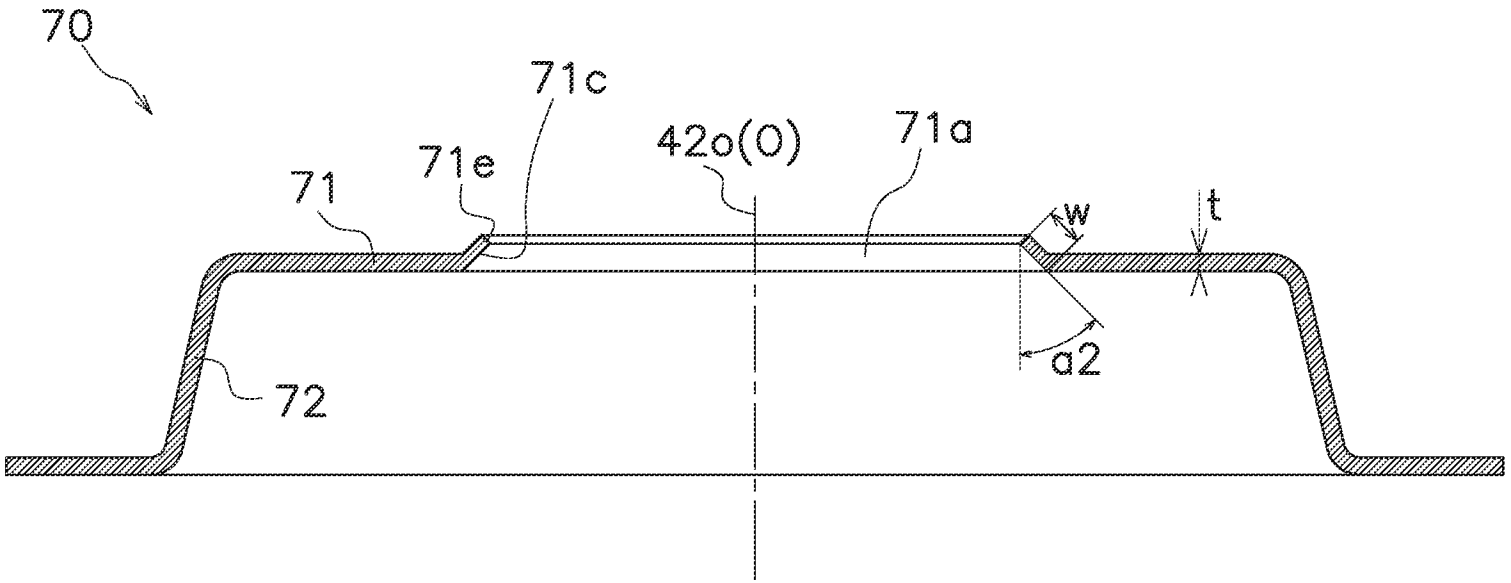
FIG. 6 is a cross-sectional view of the muffler cover 70 included in the compressor 10 according to the second embodiment.

FIG. 4 is a schematic longitudinal sectional view of the compressor 10 according to a second embodiment. FIG. 5 is an enlarged view of a portion B surrounded by a dotted line in FIG. 4. FIG. 6 is a cross-sectional view of the muffler cover 70 included in the compressor 10 according to the second embodiment. The difference between the compressor 10 according to the first embodiment and the compressor 10 according to the second embodiment is the shape of the muffler cover 70. The difference between the first embodiment and the second embodiment will be mainly described below. The same or corresponding features between the first embodiment and the second embodiment are denoted by the same reference numerals, and the description thereof will be omitted as appropriate.

(2) Detailed Configuration (2-1) Muffler Cover 70

In the compressor 10 according to the second embodiment, the upper surface 71 of the muffler cover 70 includes a second contact surface 71*c* that is part of the conical side surface formed around the first muffler opening 71*a*.

According to the present embodiment, the second contact surface 71*c* forms the side surface of the truncated cone whose diameter increases from top to bottom. The second contact surface 71*c* is formed to be in contact (surface contact) with the first contact surface 42*a* of the front head 40 in a state where the front head boss portion 42 is inserted from under the first muffler opening 71*a* and the muffler cover 70 is attached to the upper surface of the front head 40. In the same manner as the first embodiment, the first end portion 71*e* is also in contact with the first contact surface 42*a* in a state where the muffler cover 70 is attached to the upper surface of the front head 40.

The second contact surface 71*c* is preferably formed such that an angle a2 formed with the axial center 42*o* is larger than the angle a1 in the plane including the axial center 42*o* of the front head boss portion 42. In other words, the angle a1 is preferably smaller than the angle a2. Further, a width W of the second contact surface 71*c* is preferably larger than the plate thickness t of the muffler cover 70.

(3) Feature (3-1)

In the compressor 10 according to the second embodiment, the upper surface 71 includes the second contact surface 71*c* that is part of the conical side surface formed around the first muffler opening 71*a*. The second contact surface 71*c* is in contact with the first contact surface 42*a* in a state where the muffler cover 70 is attached to the front head 40.

In the compressor 10 according to the second embodiment, as both the first contact surface 42*a* and the second contact surface 71*c* are parts of the conical side surface, the first contact surface 42*a* and the second contact surface 71*c* may be in surface contact with each other in addition to the first end portion 71*e* when the front head boss portion 42 is inserted from under the first muffler opening 71*a*. Thus, the gap between the front head boss portion 42 and the first muffler opening 71*a* is sealed by the first contact surface 42*a* and the second contact surface 71*c* so that the refrigerant is prevented from flowing out through the gap between the front head boss portion 42 and the first muffler opening 71*a*. As a result, the compressor 10 according to the second embodiment effectively suppresses the occurrence of vibration and noise caused by pressure pulsation of the compressed refrigerant flowing out from the compression mechanism 30.

Furthermore, as the first contact surface 42*a* and the second contact surface 71*c* are in surface contact with each other, the elastic deformation of the second contact surface 71*c* may ensure the sealing property even when there is some variation in the dimension of the first contact surface 42*a* or the second contact surface 71*c*.

(3-2)

In the plane including the axial center 42*o* of the front head boss portion 42, the angle a1 formed between the axial center 42*o* of the front head boss portion 42 and the first contact surface 42*a* is smaller than the angle a2 formed between the axial center 42*o* of the front head boss portion 42 and the second contact surface 71*c*.

Thus, when the front head boss portion 42 is inserted from under the first muffler opening 71*a*, the vicinity of the first end portion 71*e* of the second contact surface 71*c* comes into contact with the first contact surface 42*a* earlier than the other portions. Therefore, when a downward load is applied to the muffler cover 70, the second contact surface 71*c* is elastically deformed so that the area below the vicinity of the first end portion 71*e* may be further brought into surface contact. As a result, the occurrence of vibration and noise caused by pressure pulsation of the compressed refrigerant is effectively suppressed.

(3-3)

The width w of the second contact surface 71*c* is larger than the plate thickness t of the muffler cover 70.

Thus, it is possible to elastically deform the second contact surface 71*c* as appropriate while ensuring the area where the first contact surface 42*a* and the second contact surface 71*c* may be in surface contact with each other. Therefore, even when there is some variation in the dimension of the first contact surface 42*a* or the second contact surface 71*c*, the elastic deformation of the second contact surface 71*c* may ensure the sealing property, and the occurrence of vibration and noise caused by pressure pulsation of the compressed refrigerant is effectively suppressed.

(3-4)

In In the plane including the axial center 42*o* of the front head boss portion 42, the angle a1 formed between the axial center 42*o* of the front head boss portion 42 and the first contact surface 42*a* is more than 0° and less than 45°.

This prevents a reduction in the volume of the muffler space S2 due to an excessive increase in the outer peripheral diameter of the front head boss portion 42 below the first contact surface 42*a*, and therefore the occurrence of vibration and noise caused by pressure pulsation of the compressed refrigerant is effectively suppressed.

EXAMPLES

A model of a compressor according to an example and a model of a compressor according to a comparative example were created to analyze the radiated sound.

A model of the compressor 10 according to the second embodiment illustrated in FIG. 4 was used as the example. The model of the compressor used as the comparative example is different from the compressor 10 only in that the first contact surface 42*a* and the second contact surface 71*c* are not provided. In the model of the compressor according to the comparative example, the muffler cover was arranged to be biased with respect to the front head boss portion. The clearance between the front head boss portion and the muffler cover was set to 0.6 mm.

Figure 7:
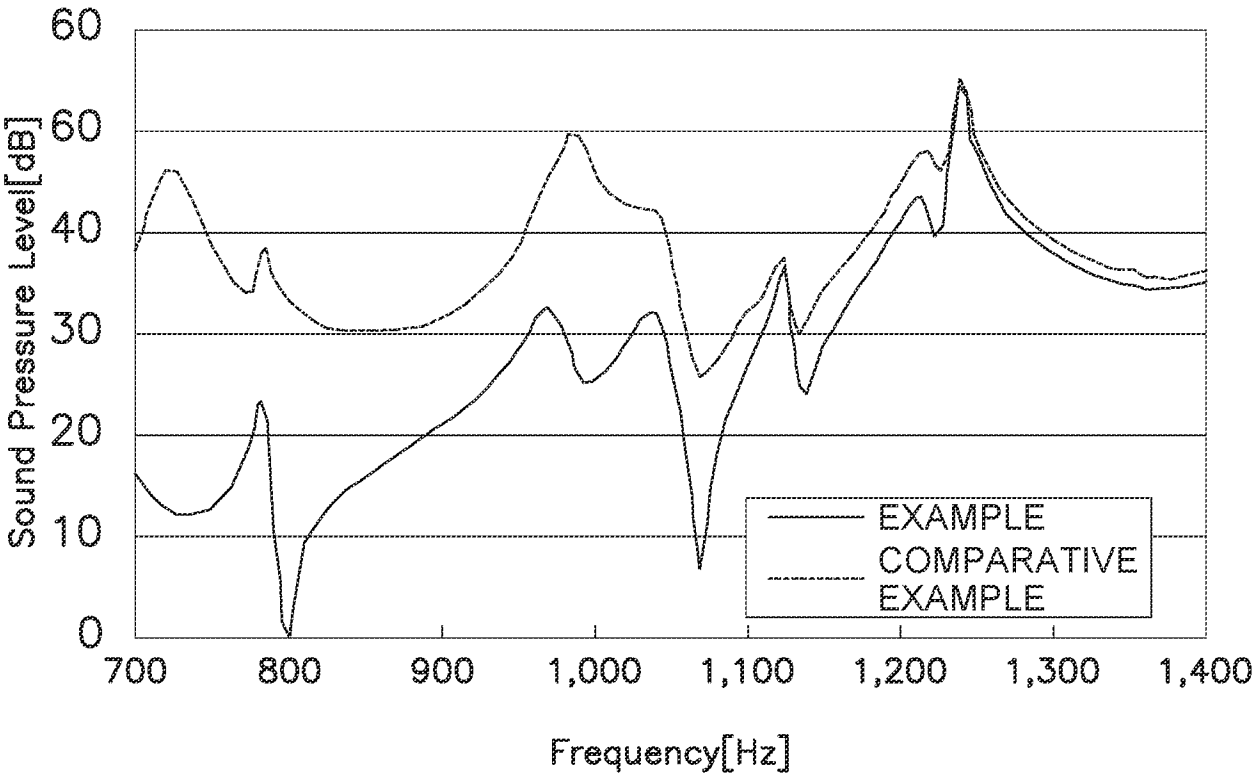
FIG. 7 is a graph illustrating analysis results using models according to an example and a comparative example.

The above-described model was used to analyze the radiated sound (Sound Pressure Level [dB]) at a predetermined distance from the surface of the casing 11 when the fluid (refrigerant) was suctioned and discharged at a predetermined speed. FIG. 7 is a graph illustrating analysis results using the models according to the example and the comparative example.

As illustrated in FIG. 7, with the use of the compressor 10 to seal the gap between the front head boss portion 42 and the first muffler opening 71*a*, a reduction in the noise level was confirmed in a wide range of frequencies.

Although the embodiment of the present disclosure has been described above, it is understood that various modifications may be made to forms and details without departing from the spirit and scope of the present disclosure described in the scope of claims.

The invention claimed is:

1. A compressor comprising:

a compression mechanism including a front head including a boss portion, and a muffler cover attached to the front head, the front head including a first contact surface that is part of a conical side surface on an outer peripheral surface of the boss portion, the first contact surface being at a first angle;

the muffler cover including a first surface having a circular first opening formed therein, into which the boss portion is inserted, a first end portion of the first surface forming the first opening being in contact with the first contact surface in a state in which the muffler cover is attached to the front head, the first surface including a second contact surface that is part of a conical side surface formed around the first opening, the second contact surface being formed at a predetermined oblique angle relative to the first surface prior to attachment of the muffler cover to the front head that is larger than the first angle, and the second contact surface being in contact with the first contact surface in a state in which the muffler cover is attached to the front head.

2. The compressor according to claim 1, wherein the muffler cover has two second openings formed therein, through which a fluid compressed by the compression mechanism passes, and when viewed in an extending direction of the boss portion, the two second openings are formed on a circumference of a predetermined radius around an axial center of the boss portion in positions at intervals of 180° with the axial center as an axis.

3. The compressor according to claim 1, wherein a width of the second contact surface is larger than a plate thickness of the muffler cover.

4. The compressor according to claim 3, wherein on a plane including the axial center of the boss portion, an angle formed between the axial center of the boss portion and the first contact surface is more than 0° and less than 45°.

5. The compressor according to claim 1, wherein on a plane including the axial center of the boss portion, an angle formed between the axial center of the boss portion and the first contact surface is more than 0° and less than 45°.

* * * * *